US007619363B2

(12) United States Patent
Whittum et al.

(10) Patent No.: US 7,619,363 B2
(45) Date of Patent: Nov. 17, 2009

(54) ELECTRONIC ENERGY SWITCH

(75) Inventors: David H. Whittum, Sunnyvale, CA (US); Eiji Tanabe, Cupertino, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 204 days.

(21) Appl. No.: 11/378,611

(22) Filed: Mar. 17, 2006

(65) Prior Publication Data

US 2007/0215813 A1 Sep. 20, 2007

(51) Int. Cl.
*H01J 25/10* (2006.01)

(52) U.S. Cl. ..... 315/5.41; 315/500

(58) Field of Classification Search ..... 315/5.39, 315/5.41, 5.42, 5.46, 500–506
See application file for complete search history.

(56) References Cited

U.S. PATENT DOCUMENTS 4,382,208 A * 5/1983 Meddaugh et al. ..... 315/5.41
4,629,938 A * 12/1986 Whitham ..... 315/5.41
6,366,021 B1 * 4/2002 Meddaugh et al. ..... 315/5.41
6,856,105 B2 * 2/2005 Yao et al. ..... 315/505
7,239,095 B2 * 7/2007 Ho et al. ..... 315/505
7,339,320 B1 * 3/2008 Meddaugh et al. ..... 315/5.41
2005/0057198 A1 * 3/2005 Hanna ..... 315/500

* cited by examiner

*Primary Examiner*—Douglas W Owens
*Assistant Examiner*—Ephrem Alemu
(74) *Attorney, Agent, or Firm*—Vista IP Law Group, LLP.

(57) ABSTRACT

An energy switch for use in a radiation system includes an element located within a structure having a cavity, the element capable of being biased by a magnetic field, and a device for generating the magnetic field to thereby bias the element. An energy switch for use in a radiation system includes a structure forming at least a part of a cavity, an element coupled to the structure and located outside the cavity, the element capable of being biased by a magnetic field, and a device for generating the magnetic field to bias the element. A method for use in a radiation procedure includes providing a first magnetic field, and using the first magnetic field to create a first bias for an element that is located outside a cavity of an accelerator, thereby changing en electric field associated with the accelerator.

42 Claims, 7 Drawing Sheets

ELECTRONIC ENERGY SWITCH

FIELD

This invention relates generally to energy switches, and more specifically, to energy switches for use with charged particle beam accelerators.

BACKGROUND

Charged particle beam accelerators have found wide usage in medical accelerators where the high energy beam is employed directly or indirectly, to generate x-rays, for therapeutic and diagnostic purposes. The electron beam generated by an accelerator can also be used directly or indirectly to kill infectious pests, to sterilize objects, to change physical properties of objects, and to perform testing and inspection of objects, such as containers, vehicles or concrete structures storing radioactive or nuclear material, or contraband.

In many applications, it is desirable that the energy of the electron beam be switchable readily and reliably. It is also desirable, in certain applications, that the switching of the beam energy be performed quickly, e.g., in a time interval on the order of milliseconds.

SUMMARY

In accordance with some embodiments, an energy switch for use in a radiation system includes an element located within a structure having a cavity, the element capable of being biased by a magnetic field, and a device for generating the magnetic field to thereby bias the element.

In accordance with other embodiments, an energy switch for use in a radiation system includes a structure forming at least a part of a cavity, an element coupled to the structure and located outside the cavity, the element capable of being biased by a magnetic field, and a device for generating the magnetic field to bias the element.

In accordance with other embodiments, a method for use in a radiation procedure includes providing a first magnetic field, and using the first magnetic field to create a first bias for an element that is located outside a cavity of an accelerator, thereby changing an electric field associated with the accelerator.

In accordance with other embodiments, a method for use in a radiation procedure includes providing a magnetic field, and using the magnetic field to reverse a sign of an electric field downstream from an energy switch, the electric field associated with an accelerator.

Other and further aspects and features will be evident from reading the following detailed description of the embodiments, which are intended to illustrate, not limit, the invention.

BRIEF DESCRIPTION OF THE DRAWINGS

The drawings illustrate the design and utility of preferred embodiments, in which similar elements are referred to by common reference numerals. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
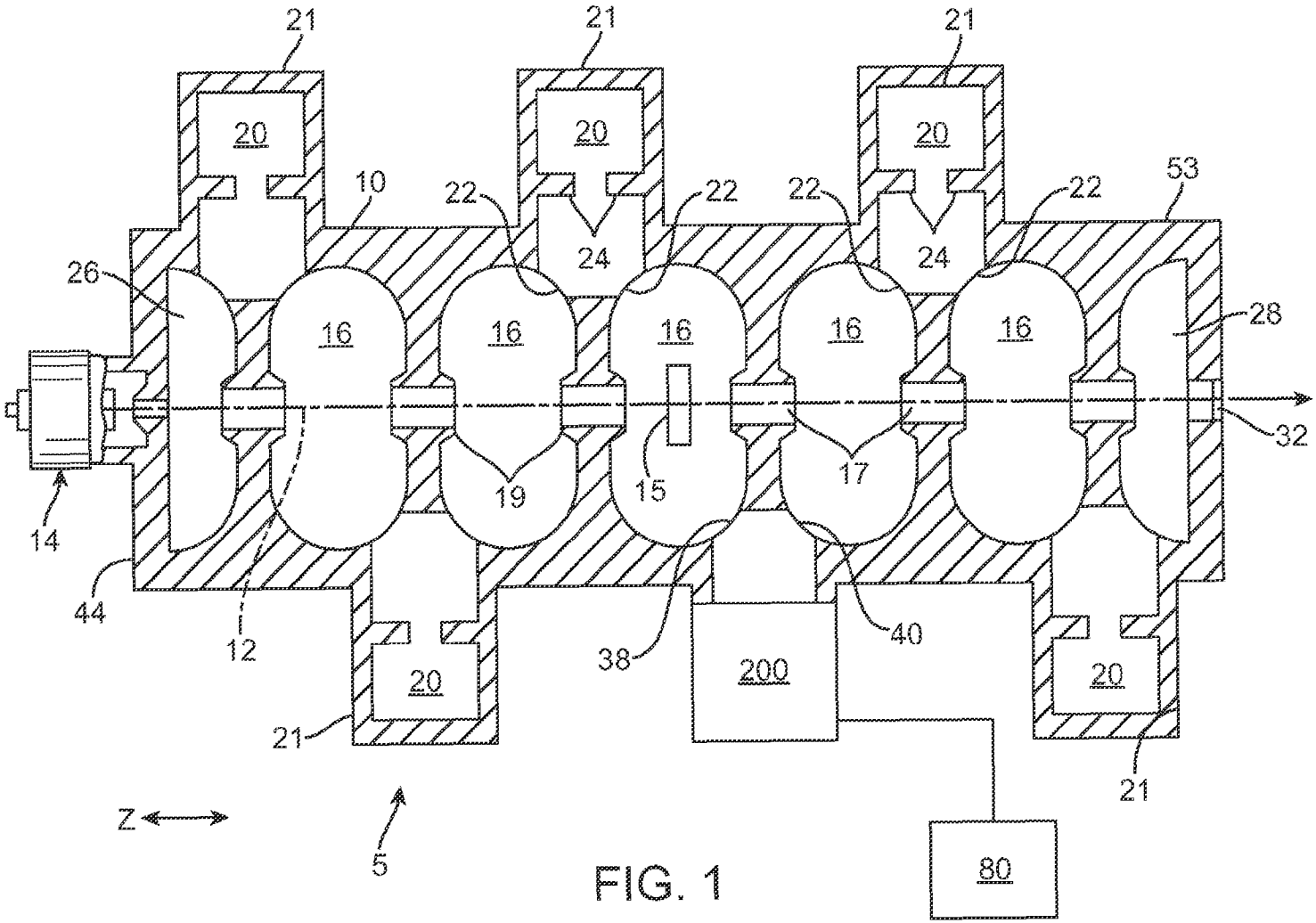
FIG. 1 is a block diagram of a radiation system having an energy switch in accordance with some embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 is a schematic side sectional view of a radiation system 5 in accordance with some embodiments. The radiation system 5 includes an accelerator 10 having a plurality of electromagnetically coupled resonant cavities (electromagnetic cavities) 16, a particle source 14 that generates and injects particles, e.g., electrons, into the accelerator 10, and an energy switch 200. Although five full cavities 16 and two half cavities 26, 28 are shown, in other embodiments, the accelerator 10 can have other numbers of cavities and/or half cavities (e.g., zero half cavities). The radiation system 5 also includes a radiofrequency power (RF) source (not shown), such as a magnetron or a klystron, that provides microwave power to the accelerator 10. The power delivered by the power source may be in a form of electromagnetic waves, and may enter one cavity 16 through an opening 15, or multiple openings. The electrons generated by the particle source 14 are accelerated through the accelerator 10 by the electromagnetic field within the cavities 16 of the accelerator 10, thereby resulting in an energetic electron beam 12. As shown in the figure, the radiation system 5 may further include a computer or processor 80, which controls an operation of the particle source 14, the RF generator, and/or the energy switch 200.

The accelerator 10 also includes a plurality of coupling bodies 21, each of which having a coupling cavity 20 that couples to one or two adjacent cavities 16. In the illustrated embodiments, the electromagnetic cavities 16 are doughnut shaped with aligned central beam apertures 17 which permit passage of the beam 12. In some embodiments, the dimensions, shape, and/or spacing of the cavities 16 in the upstream portion of the accelerator 10 are configured to improve capture, bunching, and phasing of electrons. The cavities 16 are electromagnetically coupled together through the coupling cavities 20, each of which is coupled to the one or two adjacent cavities 16 by an opening 22. During use, a vacuum or a relatively lower pressure (compared to outside the cavities 16, 20) is created inside the cavities 16 and the coupling cavities 20. In the illustrated embodiments, the coupling cavities 20 are tuned (e.g., by providing the each cavity 20 with certain shape, dimension, and configuration) to resonate at a frequency close to that of the accelerating cavities 16, but may be tuned to resonant at other frequencies in other embodiments. In the illustrated embodiments, the coupling cavities 20 are of cylindrical shape with a pair of axially projecting conductive capacitively coupled noses 24. Alternatively, the coupling cavities 20 can have other shapes and configurations. In further embodiments, the coupling cavities 20 may not have noses 24.

Figure 2:
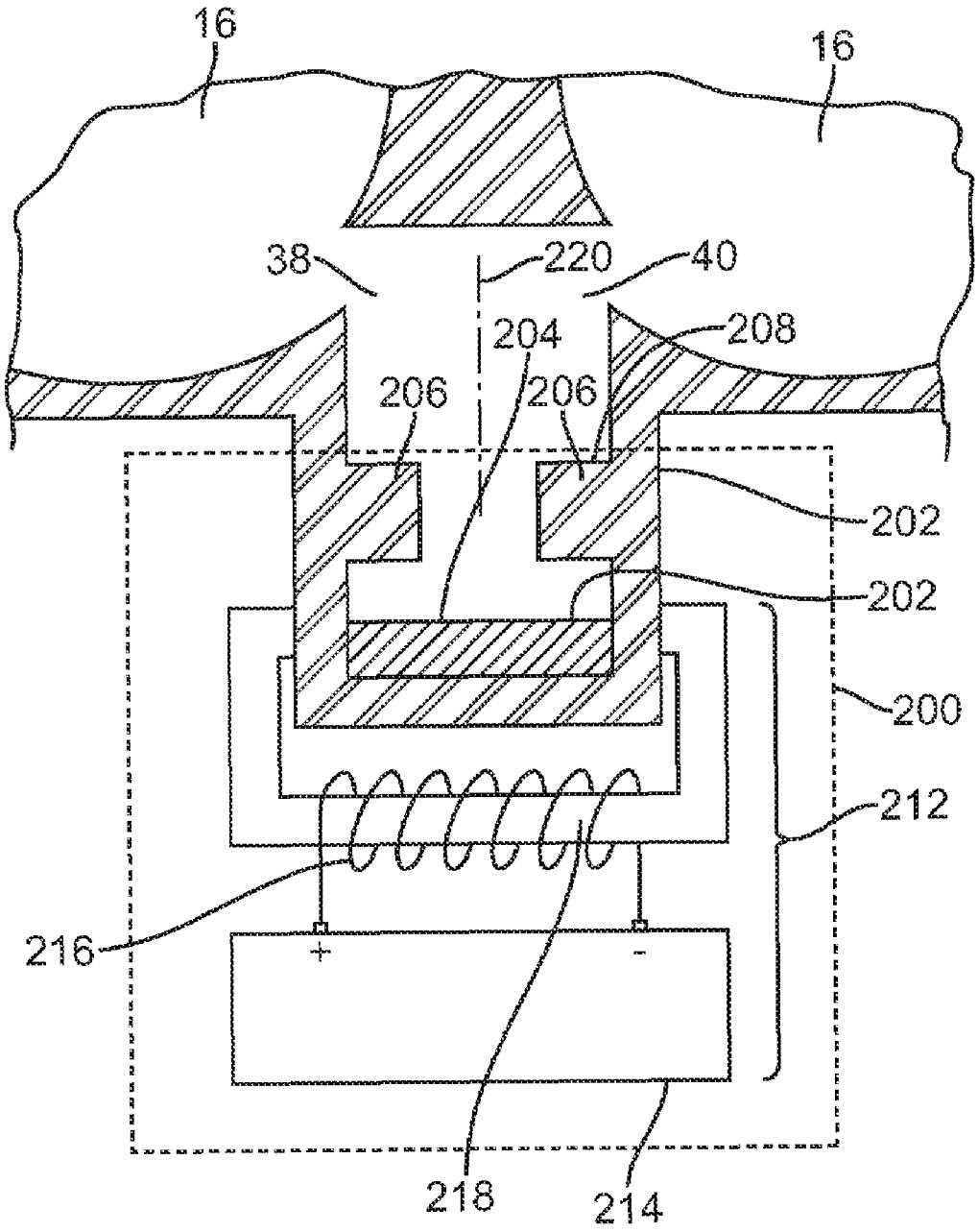
FIG. 2 illustrates the energy switch of FIG. 1 in accordance with some embodiments.

FIG. 2 shows the energy switch 200 of FIG. 1 in accordance with some embodiments. The energy switch 200 includes a structure or a body 202 having a cavity 204, and a pair of projecting conductive capacitively coupled noses 206 having opposed end faces that extend axially into the cavity 204. The structure 202 has an end 208 that is configured (e.g., sized, shaped, and/or detailed) to be secured to the accelerator 10. In the illustrated embodiments, the cavity 204 is coupled to adjacent cavities 16 through respective openings 38, 40. In the illustrated embodiments, the structure 202 is a component of the energy switch 200, which is secured to the accelerator 10. In other embodiments, the structure 202 may be a component of the accelerator 10, which is manufactured together with the accelerator 10.

The energy switch 200 also includes an element 210 fixedly secured within the cavity 204. The element 210 may comprise a material, such as ferrite material, that is capable of being biased by a magnetic field. In the illustrated embodiments, the bias of the element 210 refers to a changed in the permeability of the element 210 with respect to microwave power. In such cases, varying the magnetic field that the element 210 "sees" will change the amount of microwave power that permeates or goes into the element 210. In other embodiments, the bias of the element 210 may refer to a change in other characteristic(s), such as a permittivity, of the element 210. Also, in other embodiments, any material whose value of permittivity or permeability may be altered via electronic control or magnetic field may be used. The element 210 may have a slab configuration, in which case, there is no major opening(s) through a central portion of the element 210. Such configuration allows the element 210 to be constructed more easily, and may result in higher durability for the element 210. In other embodiments, the element 210 may have a ring configuration. The element 210 may have different shapes, such as a rectangular shape, a square shape, a circular shape, an elliptical shape, a triangular shape, or other customized shapes. Also, the element 210 may have an unsymmetrical shape in other embodiments.

Figure 3:
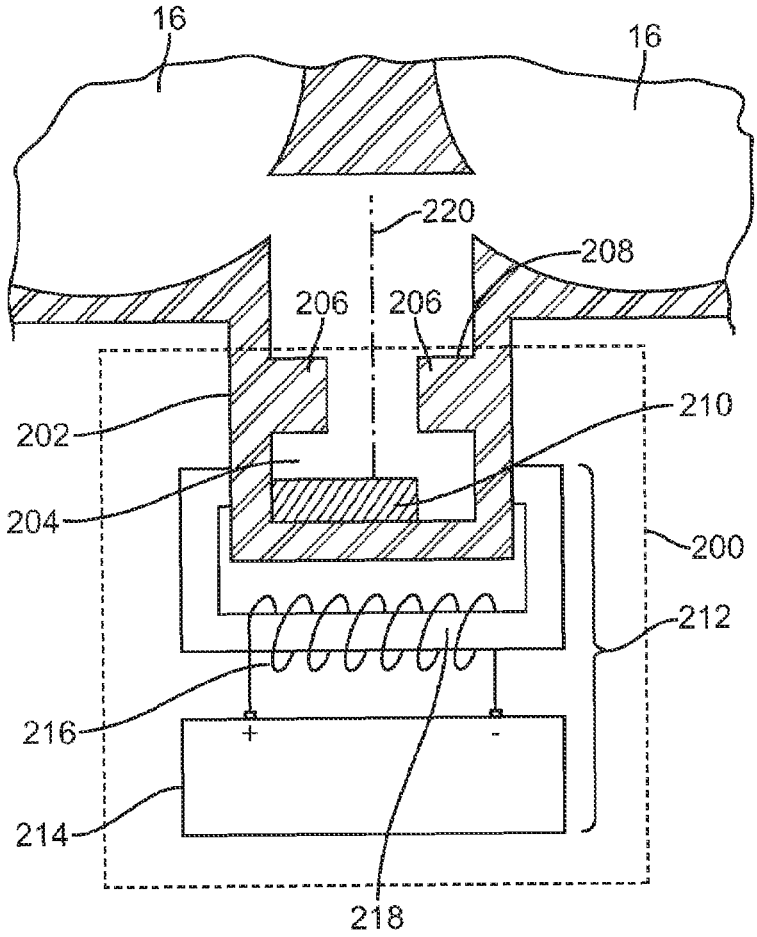
FIG. 3 illustrates the energy switch of FIG. 1 in accordance with other embodiments.

In the illustrated embodiments, the element 210 of the energy switch 200 is located at a center line 220 of the structure 202. In other embodiments, the element 210 may be positioned such that it is offset from a center line 220 of the structure 202 (FIG. 3). In the illustrated embodiments of FIG. 3, the element 210 is located upstream of the center line 220 of the structure 202. Alternatively, the element 210 may be located downstream of the center line 220. Offsetting the element 210 from the center line 220 of the structure 202 allows a desired electric field downstream from the energy switch 200 to be created. For example, offsetting the element 210 from the centerline 220 may result in an asymmetric field in the structure 202, which in turn, will have an impact on the range of electric fields that may be generated downstream using the energy switch 200. In other embodiments, instead of, or in addition to, offsetting the element 210 from the center line 220 of the structure 202, the element 210 may have a configuration (e.g., size and/or shape) that is asymmetric about the center line 220.

The energy switch 200 further includes a device 212 for generating a magnetic field using a current. In the illustrated embodiments, the device 212 includes a current source 214 for supplying a current, a coil 216 for receiving the current, and a magnetizable element 218, such as a metal. In such cases, the element 210 may be biased by changing an amount of current provided by the current source 214. For example, the element 210 may be provided a first bias by using the current source 214 to supply a first current having a first current level, and the element 210 may be provided a second bias by using the current source 214 to supply a second current having a second current level. The magnetizable element 218 may have different sizes and shapes in other embodiments, and is not limited to the configuration shown. In further embodiments, the energy switch 200 does not include the magnetizable element 218.

Figure 4:
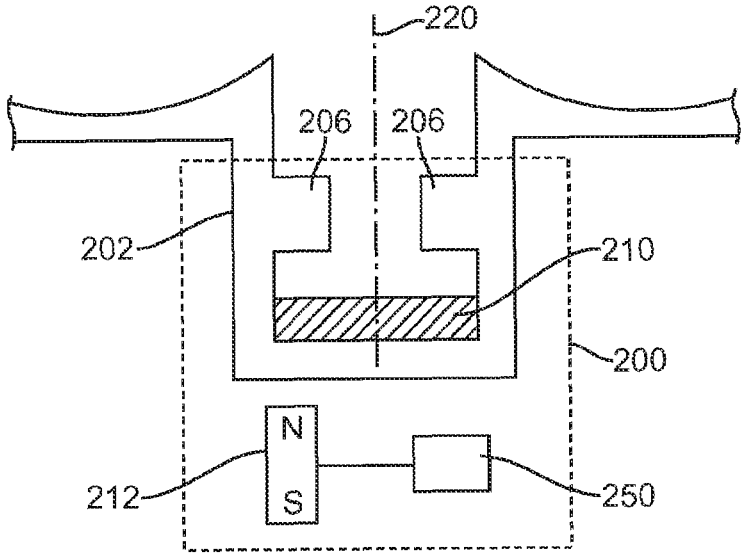
FIG. 4 illustrates the energy switch of FIG. 1 in accordance with other embodiments.

In the above embodiments, the device 212 is described as having a current source. However, the device 212 may have other configurations in other embodiments. For example, in other embodiments, the device 212 may be a permanent magnet. In such cases, the energy switch 200 may further include a positioner 250 coupled to the permanent magnet (FIG. 4). During use, the positioner 250 moves the magnet 210 relative to the element 210, thereby varying an amount of magnetic field that the element 210 sees. In other embodiments, instead of moving the permanent magnet 212 outside the structure 202, the magnet 212 (or source of magnetic field if a current source is used) may be located inside the structure 202, and may be positioned while inside the structure 202.

When using the energy switch 200, electrons are injected into the accelerator 10 by the particle source 14 at the first end 44 of the accelerator 10. The electrons pass through an upstream section of the accelerator 10 in which electrons are captured and accelerated, and enter a downstream section of the accelerator 10 where the captured electrons are further accelerated. Amplitude of the electric field in the downstream section can be adjusted by operation of the energy switch 200. In some embodiments, since the formation of electron bunches takes place in the upstream section of the accelerator 10, the bunching can be accomplished and/or optimized there, and is not significantly degraded by the varying accelerating field in the output cavities 16 of the downstream section.

Figure 5:
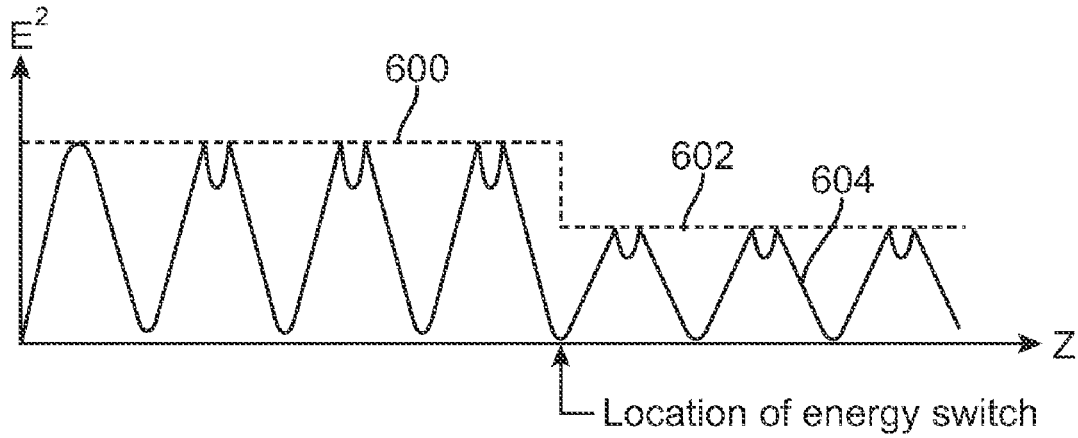
FIG. 5 illustrates an example of a profile of a squared electric field associated with an operation of the energy switch of FIG. 1 in accordance with some embodiments.
Figure 6:
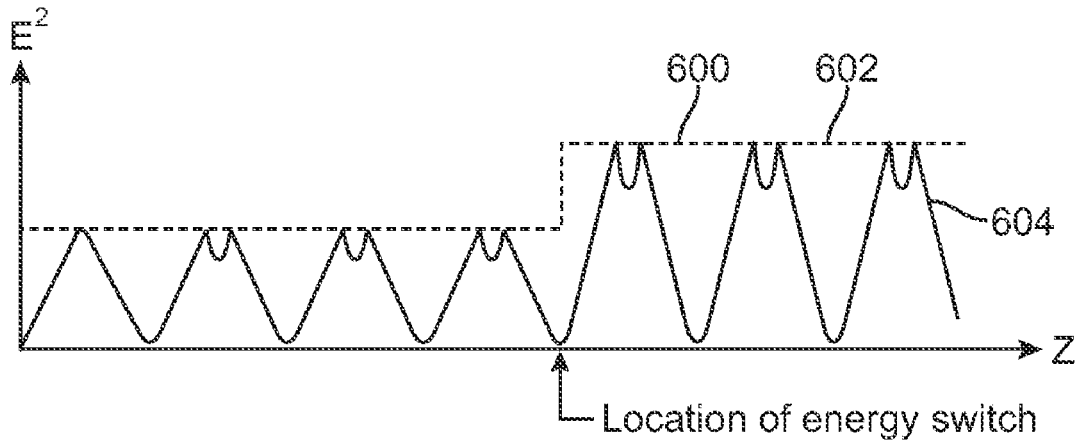
FIG. 6 illustrates an example of a profile of a squared electric field associated with an operation of the energy switch of FIG. 1 in accordance with other embodiments.

FIG. 5 illustrates an example of the profile of an electric field (squared values are shown) along the length of the accelerator 10 associated with an operation of the energy switch 200. In the figure, dashed-line 600 represents an example of an envelope 602 of electric field 604 (squared) when the element 210 is biased, e.g., by a magnetic field provided by the device 212. In other embodiments, instead of the step-down configuration shown in FIG. 5, the envelope 602 of the electric field 604 may have a step-up (FIG. 6) or a zero-step configuration, when the energy switch 200 is operated (e.g., supplying a magnetic field using the device 212). The magnitude of the electric field downstream from the energy switch 200 may be varied by operating the energy switch 200. For example, the element 210 may be biased by a magnetic field having a first magnitude to thereby create a first desired electric field downstream, and be biased by a magnetic field having a second magnitude to thereby create a second desired electric field downstream. The magnetic fields having respective first and second magnitudes may be provided by using a current source (e.g., current source 214) to supply currents having different levels. Alternatively, the magnetic fields having respective first and second magnitudes may be provided by a magnetic field source (e.g., one that has a current source, or a permanent magnet), which provides a constant magnetic field. In such cases, the magnetic field may be positioned to thereby vary an amount of magnetic field that the element 210 sees.

In any of the embodiments described herein, the energy switch 200 can be operated to control the electric field downstream thereof, so that the electric field varies between a profile having a narrow spectrum at a first energy level and a profile having a narrow spectrum at a second energy level. For example, the device 212 may be operated to generate a first current having a first current level, thereby creating a first electromagnetic field to bias the element 210. As a result, the electric field downstream has a first energy level. Next, the device 212 may be operated to generate a second current having a second current level, thereby creating a second electromagnetic field to bias the element 210. As a result, the electric field downstream has a second level. In some embodiments, a period between the time that the first current is generated and the time that the second current is generated may be a value that is between 2 milliseconds and 10 milliseconds, and more preferably, between 2 milliseconds and 4 milliseconds. This, in turn, allows the accelerator 10 to generate a beam of electrons having two energy levels that vary quickly, e.g., in the order of milliseconds. In other embodiments, the varying of the electric field may be accomplished by using a positioner to position a magnetic field (which may be provided using a current source or a magnet) between a first position and a second position relative to the element 210.

As used in this specification, the term "beam" may refer to beam pulses or a continuous beam. In the case of beam pulses, the energy switch 200 described herein may be used to create at least two beam pulses, wherein the first beam pulse has a first energy level, and the second beam pulse has a second energy level. Such may be accomplished, for example, by operating the energy switch 200 in a first mode (e.g., providing a first current, or placing a source of magnetic field at a first distance from the element 210), activating the RF power source to create a first beam pulse, turning off the RF power source, operating the energy switch 200 in a second mode (e.g., providing a second current, or placing a source of magnetic field at a second distance from the element 210), and activating the RF power source to create a second beam pulse. In the case of a continuous beam, the energy switch 200 described herein may be used to create a continuous beam having a first energy level at a first time, and a second energy level at a second time. Such may be accomplished, for example, by leaving the RF power source on while operating the energy switch 200 to vary a current (e.g., providing a first current and a second current, or varying the distance between a magnetic field source and the element 210).

In other embodiments, the accelerator 10 may use the energy switch 200 to generate an electron beam having more than two energy levels. For example, the energy switch 200 may be operated to generate currents having more than two different current levels, thereby creating an electric field downstream having more than two energy levels. Alternatively, if a positioner is used, the positioner may be used to position a magnetic field to more than two positions relative to the element 210, thereby providing more than two different bias for the element 210.

Figure 7:
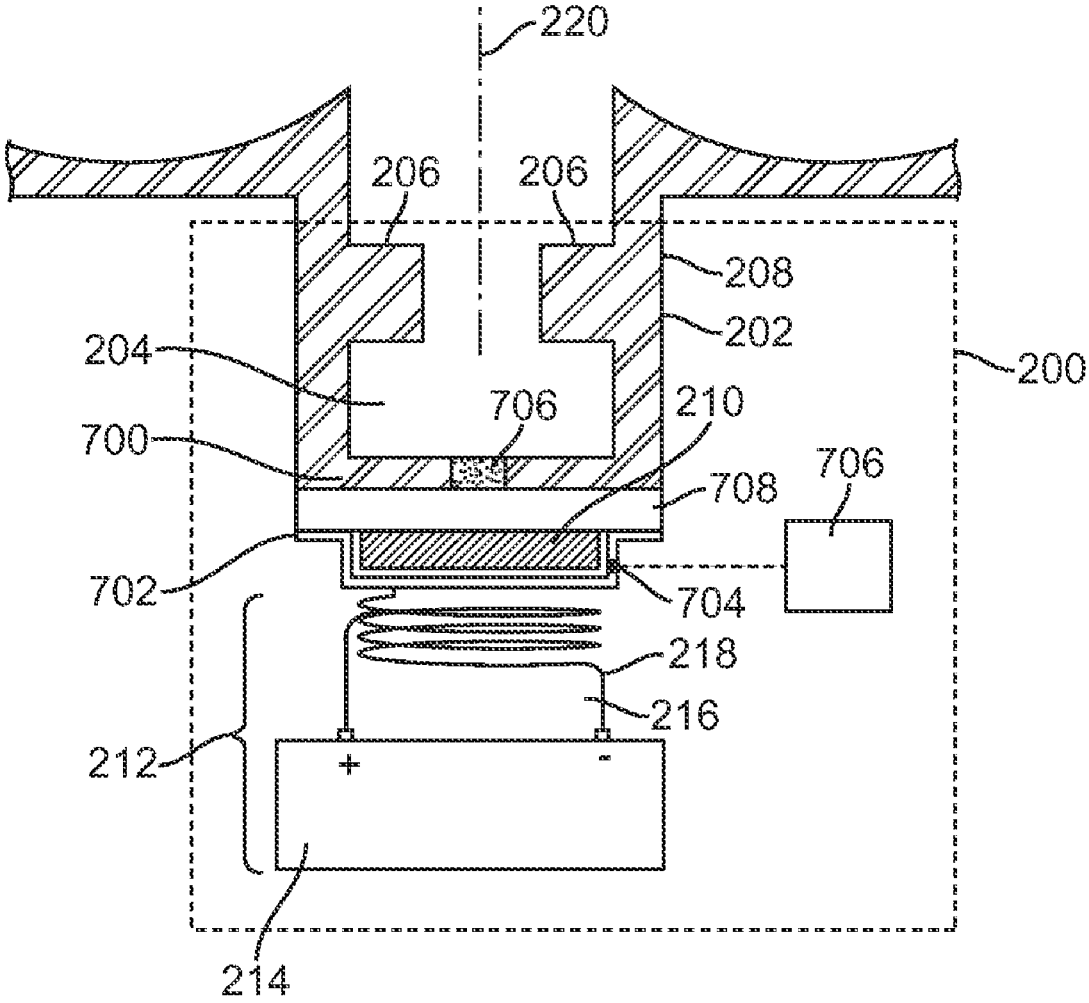
FIG. 7 illustrates the energy switch of FIG. 1 in accordance with other embodiments.

In the above embodiments, the element 210 is located within the cavity 204. However, in other embodiments, the element 210 may be located outside the cavity 204 (or outside a space enclosed by the accelerator 10). FIG. 7 illustrates the energy switch 200 of FIG. 1 in accordance with other embodiments. The energy switch 200 includes a structure or a body 202 having a cavity 204, and a pair of projecting conductive capacitively coupled noses 206 having opposed end faces that extend axially into the cavity 204. The energy switch 200 also includes an element 210, which may comprise a material, such as a ferrite material, that is capable of being biased by an magnetic field, as discussed. The energy switch 200 further includes a device 212 for generating an electromagnetic field using a current, which includes an electric source 214 for supplying a current, and a coil 216 for receiving the current. In other embodiments, the device 212 may further include a magnetizable element for directing magnetic field to the element 210. In further embodiments, the device 212 may be a permanent magnet. In such cases, the energy switch 200 may further include a positioner for positioning the magnet 212 relative to the element 210. Also, in any of the embodiments described herein, the device 212, or any of the components of the device 212, may be located within the space defined by the cover 702.

The energy switch 200 of FIG. 7 further includes an opening 706 at an end wall 700 of the structure 202, and a ceramic material 708 that covers the opening 706. As shown in the figure, the element 210 is secured to the ceramic material 708, and is located outside the cavity 204. The opening 706 and the ceramic material 708 (which admits microwave power) allow the biased element 210 to affect (e.g., introduce or change) an amount of reactance coupled to the cavity 204. The ceramic material 708 also functions to seal the opening 706 to thereby allow a vacuum to be created inside the cavity 204 during use. Placing the element 210 outside the cavity 204 is beneficial in that it allows the element 210 to be repaired, serviced, or replaced, more easily. Such configuration also prevents particles (due to break down of the element 210, or due to contamination of the element 210 due to the manufacturing of the element 210) from the element 210 from contaminating the interior of the accelerator 10. The magnetic field generating device 212 may be secured relative to the structure 202 via a frame, an arm, or any of other structures (not shown). The operation of the energy switch 200 is similar to that discussed previously.

As shown in the illustrated embodiments, the element 210 may be covered by a cover 702, which may be made from copper or any of other suitable materials. The cover 702 may be used to protect the element 210. In other embodiments, the cover 702 may also cover the ceramic material 708 to shield it from the exterior environment. The cover 702 includes an opening 704, which allows a fluid (gas or liquid), such as SF6 gas to be injected from a source (e.g., gas tank) 709 into a space enclosed by the cover 702. The SF6 gas may optionally be employed to inhibit microwave breakdown due to high field. In other embodiments, the gas source 709 and the opening 704 are optional, and the energy switch 200 does not include the gas source 709 and the opening 704.

In other embodiments, the structure 202 may have more than one openings 706. Also, in other embodiments, the opening(s) 706 needs not be centered along the center line 220 of the structure 202, and may be offset from the center line 220. In further embodiments, instead of having the opening(s) 706 at an end wall of the structure 202, the opening(s) may be located along a side wall of the structure 202. In such cases, the ceramic material 708 and the magnetically biasable element 210 may be secured to the side wall of the structure 202. In further embodiments, instead of having the symmetrical configuration shown in FIG. 7, the energy switch 200 may have an asymmetrical configuration. For example, in other embodiments, the energy switch 200 of FIG. 7 may have the element 210 offset from the center line 220. Also, in further embodiments, the element 210 may have a configuration (e.g., size and/or shape) that is asymmetric relative to the center line 220.

Figure 8:
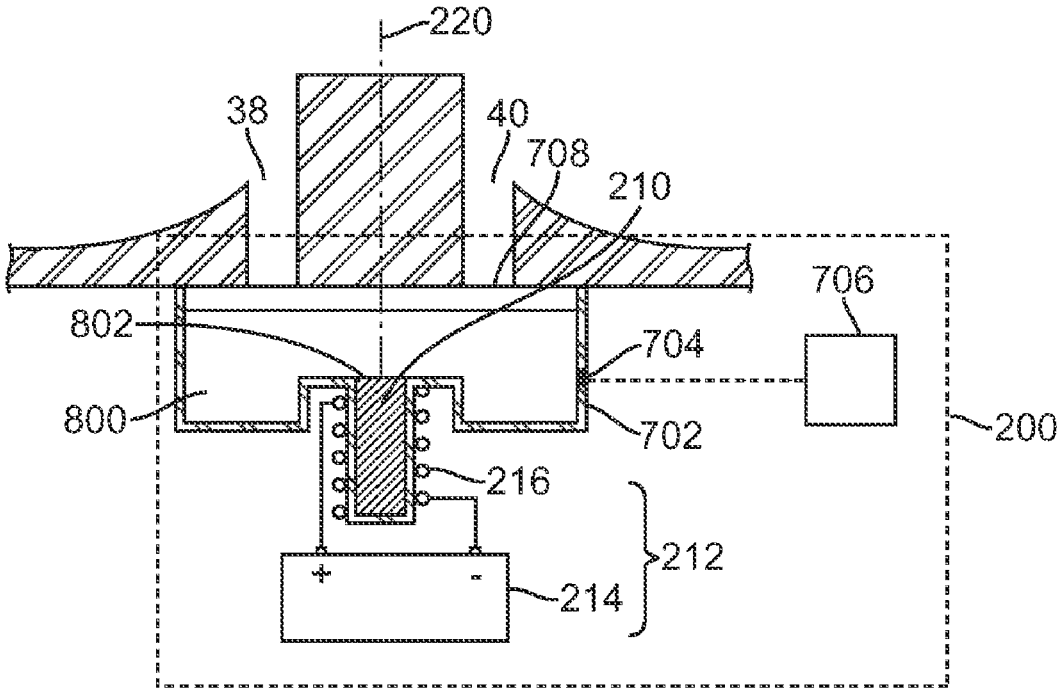
FIG. 8 illustrates the energy switch of FIG. 1 in accordance with other embodiments.

FIG. 8 illustrates the energy switch 200 of FIG. 1 in accordance with other embodiments. The energy switch 200 of FIG. 8 is similar to that described with reference to FIG. 7, except that the energy switch 200 does not include the structure 202. In the illustrated embodiments, the cover 702 defines a cavity 800, and has an opening 802 for accommodating the element 210. In some embodiments, the width of the opening 802 or a cross sectional dimension of the element 210 may be a value that is between $0.01\lambda$(wavelength of the electromagnetic wave inside the cavity) to $0.2\ \lambda$, and more preferably, approximately $0.05\ \lambda$(i.e., $0.05\ \lambda \pm 0.02\ \lambda$). In other embodiments, the width of the opening 802 or the cross sectional dimension of the element 210 may have other values. The energy switch 200 includes a device 212 for generating an magnetic field using a current, which includes an electric source 214 for supplying a current and a coil 216 for receiving the current. In the illustrated embodiments, the coil 216 is located around the element 210. Such configuration allows the element 210 to be biased by a current supplied to the coil 216, thereby adjusting a magnitude of the electric field downstream from the element 210. In other embodiments, instead of the configuration described, the device 212 may be a permanent magnet for supplying a magnetic field. The cover 702 also includes an opening 704, which allows a fluid (gas or liquid), such as SF6 gas to be injected from a source (e.g., gas tank) 709 into a space enclosed by the cover 702. The SF6 gas may optionally be employed to inhibit microwave breakdown due to high field. In other embodiments, the gas source 709 and the opening 704 are optional, and the energy switch 200 does not include the gas source 709 and the opening 704.

Figure 9:
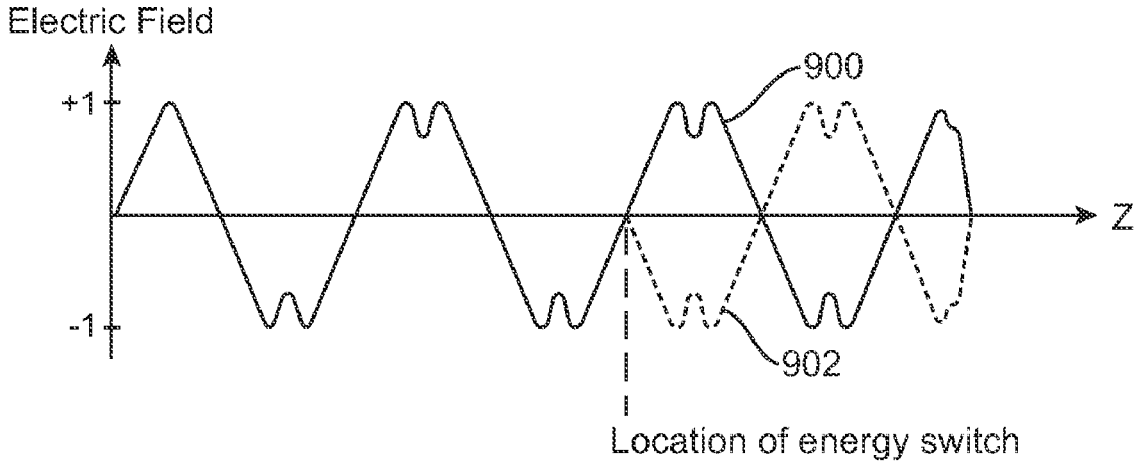
FIG. 9 illustrates an example of an electric field profile resulting from operation of the energy switch of FIG. 1 in accordance with other embodiments.

In any of the embodiments described herein, the energy switch 200 may be configured (e.g., sized, shaped, and/or detailed) to perform phase flip. FIG. 9 illustrates an example of an electric field diagram, wherein the solid line 900 represents an electric field profile (normalized) along the length of the accelerator 10. In the illustrated example, the solid line 900 represents an electric field profile when the energy switch 200 is off, and the dashed line 902 represents an electric field profile when the energy switch 200 is operated (e.g., when the device 212 is used to supply a magnetic field). In other examples, the solid line 900 may represent an electric field profile when the energy switch 200 is operated in a first manner (e.g., when the device 212 is used to supply a magnetic field having a first magnitude), and the dashed line 902 may represent an electric field profile when the energy switch 200 is operated in a second manner (e.g., when the device 212 is used to supply a magnetic field having a second magnitude that is different from the first magnitude). As shown in the figure, operating the energy switch 200 may result in the electric field downstream from the energy switch 200 being shifted 180° in phase, thereby flipping the sign of the electric field. In such cases, the energy remains the same, but the sign is reversed.

In any of the embodiments described herein, the energy switch 200 can be located at other position along the length of the accelerator 10, instead of that shown in the illustrated embodiments. Furthermore, although only one energy switch 200 is shown in the previously described embodiments, alternatively, the accelerator 10 can have a plurality of energy switches 200.

In further embodiments, in addition to using the element 210 to adjust an electric field, a field step control may also be employed to provide an asymmetric magnetic field. The field step control may be implemented by providing the slots 38, 40 with different sizes and/or shapes. In other embodiments, the field step control may be implemented by changing a configuration (e.g., a size, shape, detail, etc.) of the coupling body 20 or the structure 202. The field step control allows a desired electric field downstream from the energy switch 200 to be created. In some embodiments, the field step control also provides a broader bandwidth for the accelerator 10, allowing the accelerator 10 to generate x-ray beams with a wider range of energy levels and minimum energy spread. Field step control has been described in U.S. patent application Ser. No. 10/745,947, the entire disclosure is expressly incorporated by reference herein.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed:

1. An energy switch for use in a radiation system, comprising:

an element located within or outside a structure having a cavity, the element capable of being biased by a magnetic field to change an operating mode of the cavity, wherein the cavity is coupled to a first adjacent cavity through a first opening and to a second adjacent cavity through a second opening; and a device for generating the magnetic field to thereby bias the element.

2. The energy switch of claim 1, wherein the element comprises a ferrite material.

3. The energy switch of claim 1, further comprising the structure.

4. The energy switch of claim 3, wherein the structure is a side coupling body of an accelerator.

5. The energy switch of claim 3, wherein the structure is configured to be secured to an accelerator.

6. The energy switch of claim 3, wherein the structure has an end wall, and the element is secured to the end wall.

7. The energy switch of claim 1, wherein the device comprises circuitry for generating the magnetic field using a current, and the magnetic field is an electromagnetic field.

8. An energy switch for use in a radiation system, comprising:

an element located within or outside a structure having a cavity, the element capable of being biased by a magnetic field; and a device for generating the magnetic field to thereby bias the element;

wherein the device comprises a permanent magnet.

9. An energy switch for use in a radiation system, comprising:

an element located within or outside a structure having a cavity, the element capable of being biased by a magnetic field;

a device for generating the magnetic field to thereby bias the element; and a positioner coupled to the device, the positioner configured to move a magnetic structure.

10. The energy switch of claim 1, wherein the device is configured to vary the magnetic field.

11. The energy switch of claim 1, wherein the device is configured to vary the magnetic field at an interval that is between 2 milliseconds to 10 milliseconds.

12. The energy switch of claim 1, wherein the element is offset from a centerline of the structure.

13. The energy switch of claim 1, wherein the element is coupled to the structure and is located outside the cavity.

14. The energy switch of claim 13, wherein the structure comprises a side coupling body of an accelerator.

15. The energy switch of claim 13, wherein one end of the structure is configured to connect to an accelerator.

16. The energy switch of claim 13, wherein the element comprises a ferrite material.

17. The energy switch of claim 13, wherein the structure comprises at least one opening.

18. The energy switch of claim 17, further comprising a ceramic material coupled to the structure.

19. The energy switch of claim 18, wherein the ceramic material covers the at least one opening of the structure.

20. The energy switch of claim 13, further comprising a ceramic material coupled to the structure.

21. The energy switch of claim 13, wherein the device comprises circuitry for generating the magnetic field using a current, and the magnetic field is an electromagnetic field.

22. The energy switch of claim 13, wherein the device comprises a permanent magnet.

23. The energy switch of claim 13, further comprising a positioner coupled to the device.

24. The energy switch of claim 13, wherein the device is configured to vary the magnetic field.

25. The energy switch of claim 24, wherein the device is configured to vary the magnetic field at an interval that is between 2 milliseconds to 10 milliseconds.

26. The energy switch of claim 13, wherein the element is offset from a centerline of the structure.

27. The energy switch of claim 13, further comprising a cover for covering the element.

28. The energy switch of claim 27, wherein the cover has an opening for allowing a fluid to be delivered therethrough.

29. The energy switch of claim 28, wherein the fluid comprises SF6 gas.

30. A method for use in a radiation procedure, comprising:

providing a first magnetic field; and using the first magnetic field to create a first bias for an element that is located inside or outside a cavity of an accelerator to change an operating mode of a cavity, thereby changing an electric field associated with the accelerator, wherein the cavity is coupled to a first adjacent cavity through a first opening and to a second adjacent cavity through a second opening.

31. The method of claim 30, further comprising:

providing a second magnetic field; and using the second magnetic field to create a second bias for the element.

32. The method of claim 31, wherein a period between providing the magnetic field and providing the second magnetic field is a value that is between 2 milliseconds and 10milliseconds.

33. The method of claim 30, wherein the cavity comprises a vacuum or a pressure that is less than a pressure at the outside.

34. The method of claim 30, wherein the element comprises a ferrite material.

35. The method of claim 30, wherein the magnetic field is generated using a current.

36. The method of claim 30, wherein the first bias is created for the element by changing a permeability of the element with respect to microwave power.

37. A method for use in a radiation procedure, comprising:

providing a magnetic field; and using the magnetic field to change an operating mode of a microwave energy switch to reverse a sign of an electric field downstream from the microwave energy switch, the electric field associated with an accelerator.

38. The method of claim 37, wherein the magnetic field is used to bias an element, the element comprising a ferrite material.

39. The method of claim 38, wherein the element is biased by changing a permeability of the element with respect to microwave power.

40. The method of claim 1, wherein the element is located inside the cavity.

41. The method of claim 30, wherein the element is located inside the cavity.

42. The method of claim 30, wherein the element is located outside the cavity.

* * * * *